US006481224B2

(12) United States Patent
Elwood et al.

(10) Patent No.: US 6,481,224 B2
(45) Date of Patent: Nov. 19, 2002

(54) VACUUM FLUORESCENT ICONOGRAPHIC DISPLAY FOR A LOW TEMPERATURE REFRIGERATION UNIT

(75) Inventors: Bryan M. Elwood, Candler, NC (US); Robert D. Lehman, III, Peachtree City, GA (US)

(73) Assignee: Kendro Laboratory Products, Inc., Asheville, NC (US)

( * ) Notice: Subject to any disclaimer, the term of this patent is extended or adjusted under 35 U.S.C. 154(b) by 0 days.

(21) Appl. No.: 09/738,186

(22) Filed: Dec. 15, 2000

(65) Prior Publication Data

US 2002/0073719 A1 Jun. 20, 2002

(51) Int. Cl.[7] ..... F25B 49/02
(52) U.S. Cl. ..... 62/127; 62/130; 62/131
(58) Field of Search ..... 62/125, 126, 127, 62/129, 130, 230, 131; 236/94; 165/11.1

(56) References Cited

U.S. PATENT DOCUMENTS 3,946,574 A * 3/1976 Portera ..... 62/230 X
4,307,775 A * 12/1981 Saunders et al. ..... 62/127 X
4,387,578 A * 6/1983 Paddock ..... 62/127
4,573,325 A * 3/1986 Chiu et al. ..... 62/129
4,685,615 A * 8/1987 Hart ..... 236/94 X
5,490,556 A * 2/1996 Pichotta ..... 62/230 X
6,101,820 A * 8/2000 Cheballah ..... 62/127

* cited by examiner

*Primary Examiner*—Harry B. Tanner
(74) *Attorney, Agent, or Firm*—Baker & Hostetter L.L.P.

(57) ABSTRACT

A vacuum fluorescent iconographic display (10) operable to communicate the operating conditions of a low temperature refrigeration unit (5), with the display (10) using only intuitively recognizable pictorial iconic elements (12), numeric elements (14), and recognized symbolic elements (16) to convey the information. The iconic elements (12) unambiguously represent the various operating conditions without reliance on legends or other conventional written or spoken language, thereby avoiding translation or interpretation mistakes due to the use of such a conventional language in a possibly international product or multi-lingual situation. The iconic elements (12) may also be used in diagnostic applications by lighting, for example, in combination with the numeric elements (14) to communicate quantitative diagnostic measurements of the subsystem represented by the icon. Because it employs vacuum fluorescence technology, the iconographic display (10) is bright and visible from a large range of viewing angles, further aiding recognition of the displayed information.

27 Claims, 3 Drawing Sheets

VACUUM FLUORESCENT ICONOGRAPHIC DISPLAY FOR A LOW TEMPERATURE REFRIGERATION UNIT

BACKGROUND OF THE INVENTION

1. Field of the Invention

The present invention relates to informative displays for use with low temperature refrigeration units. More particularly, the invention relates to a vacuum fluorescent iconographic display using icons, numerals, and recognized symbols for communicating to a technician the operating conditions of an associated low temperature refrigeration unit.

2. Description of the Prior Art

It is often desirable to audit or monitor the operating conditions of a low temperature refrigeration unit. Depending on the nature of the contents cooled and stored within the unit, an awareness of the unit's operation and potential problems can prove invaluable, cost-saving, or even life-saving. For example, if the contents are biological samples, the thawing of those samples because of an unmonitored or unrecognized condition of the low temperature refrigeration unit could result in a complete loss of the possibly irreplaceable samples. In another example, if the contents are vaccines or other medicines or medical testing material, thawing could render the contents ineffective or even dangerous.

Some low temperature refrigeration units lack any sort of display or monitoring system, or include only the most primitive indicators monitoring the most obvious conditions. Such displays are often cumbersome and confusing, requiring a knowledge of the language or cryptic symbology with which the displays communicate. One existing temperature reporting system, for example, requires deciphering a circular chart upon which the temperature record appears. The circular chart itself must be frequently replaced and the system as a whole maintained for the display to be trustworthy. Another system uses light emitting diodes (LEDs) in combination with an interpretive legend. Even were a technician able to read and understand the legend of this latter system, confusing the LEDs or misinterpreting their significance can easily result in the loss of irreplaceable or costly contents or the unsafe use of contents damaged because of an unmonitored or unrecognized condition of the low temperature refrigeration unit.

Some existing iconographic displays use an iconic opening backlit by an LED. Unfortunately, backlit displays are visible only from a limited range of viewing angles, typically only within a few degrees from the direct front of the display, making them difficult to read in many situations. Furthermore, an LED that has ceased to operate properly can be difficult to identify, increasing the likelihood of a technician not recognizing the occurrence of the condition associated with that LED. Liquid crystal iconographic displays also suffer from a viewing angle limitation.

Due to the above identified and other limitations of the current art, a need exists for an improved communicative display.

SUMMARY OF THE INVENTION

The present invention solves the above-described and other problems and provides a distinct advance in the art of communicative displays for low temperature refrigeration units. More particularly, the present invention provides a vacuum fluorescent iconographic display operable to quickly, efficiently, and reliably communicate the operating conditions of a low temperature refrigeration unit with which the display is associated. This is accomplished without reliance on legends or conventional written language of any sort or high-maintenance schemes or devices.

In a preferred embodiment, the iconographic display uses only unambiguous pictorial icons, numbers, and recognized symbols to convey information. The icons represent and are easily and intuitively identifiable with various unit conditions. This allows the display to avoid translation or interpretation mistakes inherent in using a written or spoken language in a possibly international product or multi-lingual situation.

The icons may also be useful in diagnostic applications, by lighting, for example, in combination with the numerical display to communicate quantitative diagnostic measurements of the subsystem represented by the icon.

Because it employs vacuum fluorescence technology, the iconographic display is brighter and visible from a greater range of viewing angles than the existing art, further aiding in the recognition of reported conditions.

These and other features of the present invention are more fully described below in the section entitled A DETAILED DESCRIPTION OF A PREFERRED EMBODIMENT.

BRIEF DESCRIPTION OF THE DRAWING FIGURES

A preferred embodiment of the present invention is described in detail below with reference to the attached drawing figures, wherein.

DETAILED DESCRIPTION OF A PREFERRED EMBODIMENT

Figure 1:
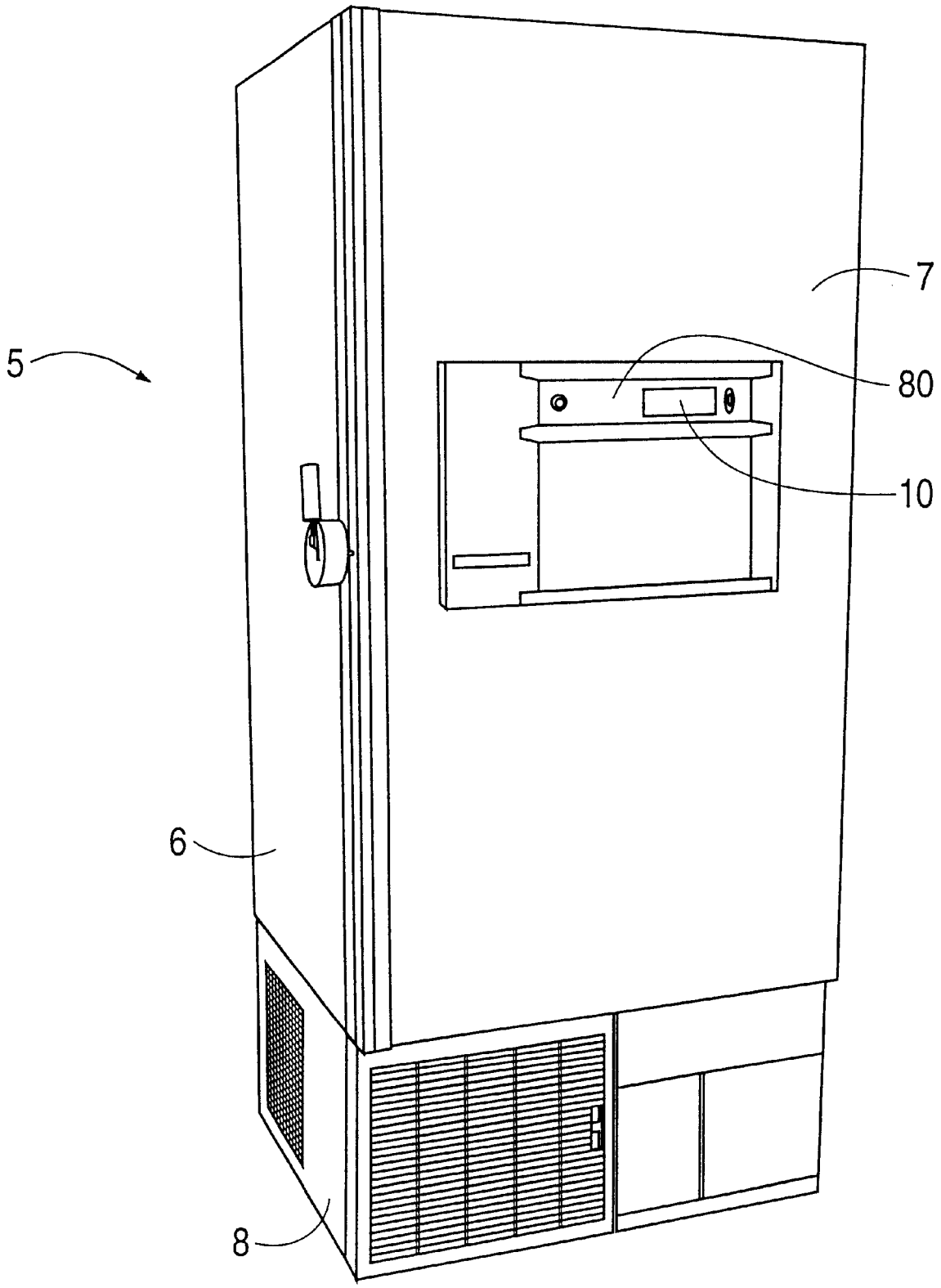
FIG. 1 is a perspective view of a low temperature refrigeration unit showing a preferred placement for the iconographic display of a preferred embodiment the present invention.

Referring to FIG. 1, a low temperature refrigeration unit 5 is shown to which is mounted a preferred embodiment of the vacuum fluorescent iconographic display 10 of the present invention operable to iconically, numerically, and symbolically communicate various operating conditions of the unit 5. The low temperature refrigeration unit 5 is conventional, being used to cool and store material within one or more interior compartments, and broadly shown comprising a housing 6; a door 7; and a compressor section 8. The present invention is independent of any particular refrigeration device.

Various desirable and undesirable operating conditions can occur while the unit 5 is performing its cooling and storing functions. Those skilled in the art will be aware of the various subsystems associated with a typical unit 5 and with their desirable proper operation. Undesirable operating conditions occur when a subsystem operates improperly, possibly by exceeding pre-established reference values. For example, the interior storage compartment (not shown) must be maintained to within a few degrees of a desired cooling and storage temperature. An undesirable operating condition occurs when the interior temperature exceeds its allowable range. The display 10 of the present invention is operable to quickly and reliably communicate this undesirable operating condition so that steps may be taken to mitigate potential undesirable results.

Figure 2:
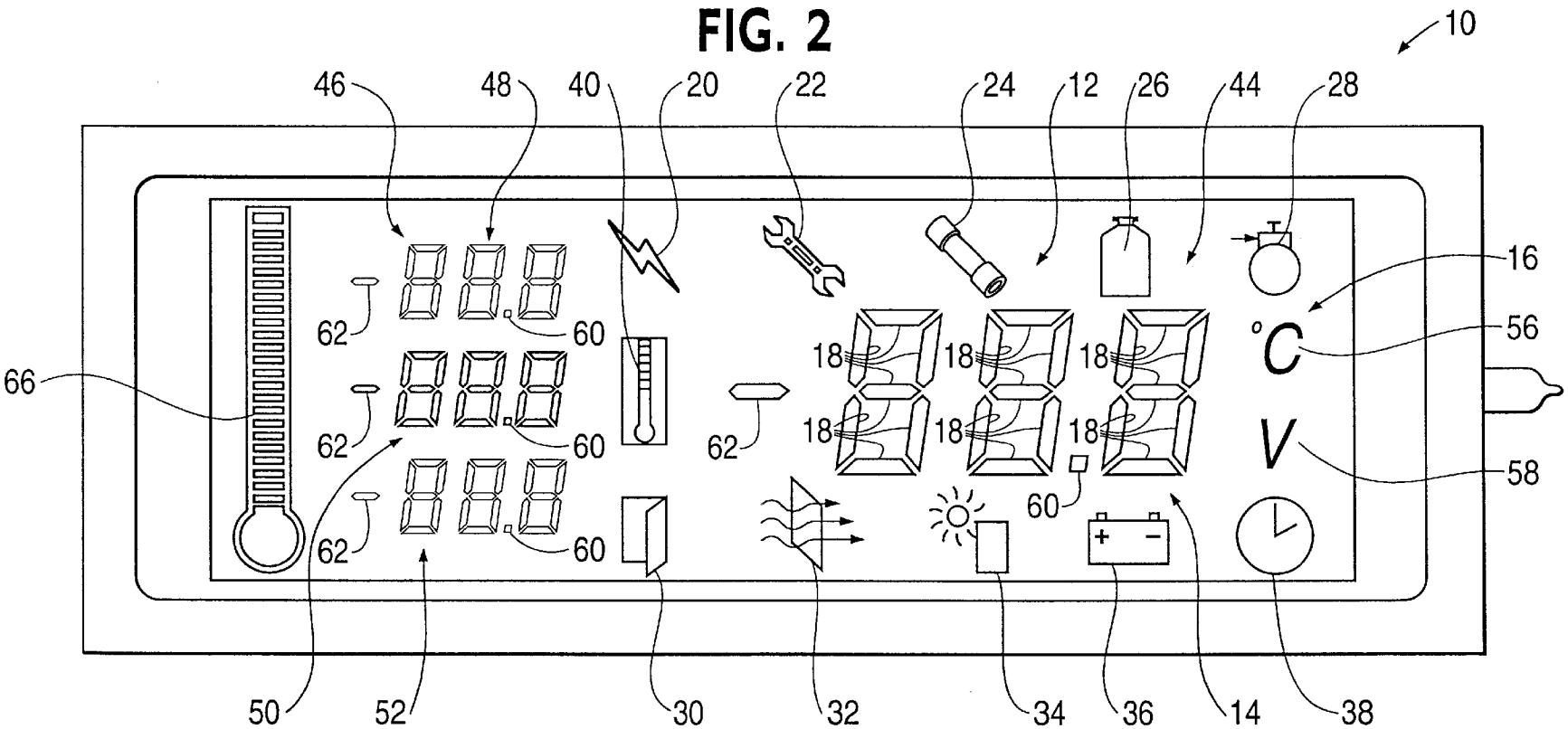
FIG. 2 is a plan view of the iconographic display of a preferred embodiment of the present invention.

Referring to FIG. 2, the vacuum fluorescent iconographic display 10 is shown in more detail. It should be noted that the particular display 10 shown is for illustration purposes only and the present invention is not limited to the specific iconic, numeric, or symbolic elements shown or their arrangement. Nor should the present invention be interpreted as requiring that any particular iconic element be associated with any particular condition; rather, the only requirement being that the iconic element identifiably, preferably intuitively, represent the condition with which it is meant to be associated. For example, though the "maintenance required" condition is represented iconically by a wrench, as described below, equally preferred alternate iconic representations for this condition include a workman holding a wrench, a workman holding a toolbox, a toolbox, a hammer, or a screwdriver.

The display 10 is shown comprising a plurality of iconic elements (icons) 12; a plurality of numeric elements (numbers 14); and a plurality of symbolic elements (symbols) 16. Each icon 12, number 14, or symbol 16 maybe constructed from one or more element segments 18, as may be practical. Thus, for example, the numbers 14 are shown each comprising seven element segments 18.

The icons 12 are operable to provide qualitative information relating to the operating conditions of the low temperature refrigeration unit 5. The icons are also operable, in some instances, to provide context to the numbers 14. Each icon 12 is preferably intuitively, if not universally, identifiable as being associated with a particular operating condition of the low temperature refrigeration unit 5. Whether the activated icons 12 light steadily, flash intermittently, or perform some combination thereof is a matter of design choice.

The preferred iconographic display 10 incorporates ten icons 12, including: a lightening bolt icon 20 indicative of a power failure; a service icon 22 indicative of a condition requiring maintenance; a fuse icon 24 indicative of a blown fuse condition; a bottle icon 26 indicative of the operation of a back-up cooling system; a compressor icon 28 indicative of a compressor temperature condition which exceeds a reference maximum; a door icon 30 indicative of a door ajar or open condition; a filter icon 32 indicative of a clogged filter condition; an ambient temperature icon 34 indicative of an ambient temperature condition which exceeds a reference maximum; a battery icon 36 indicative of a low-charge battery condition; a timer icon 38 indicative of the operation of a timer typically associated with various sub-systems of a low temperature refrigeration unit, including, for example, a re-start delay; and a small thermometer icon 40 indicative of an interior temperature condition which exceeds a reference maximum.

The numbers 14 are operable to provide quantitative information, either separate from or in combination with the qualitative information provided by the icons 12, relating to the operating conditions of the low temperature refrigeration unit 5. The preferred display 10 includes numbers 14 arranged in groups of three, each grouping being thereby operable to display a range of numbers between 00.0 and 999, depending upon desired range and degree of precision (i.e., whether the decimal point is enabled). One group 44 is shown larger than other groups 46 and is meant to provide a general purpose number display operable to communicate quantitative information related to a number of different operating conditions.

A trio of number groupings 46 are also shown, including a maximum temperature number group 48, a set point temperature number group 50, and a minimum temperature number group 52. These number groups 46 are dedicated to displaying only temperature reference values related to the desired interior temperature of the unit 5.

It is contemplated, though not shown and not part of the present invention, that a technician using the display 10 have access to a selection means, such as one or more buttons, whereby the technician may select the operating condition for which quantitative information is desired. It is further contemplated, though not shown and not part of the present invention, that the technician also have access to a setting means, such as one or more buttons, which in conjunction with the numbers 14 may be used to set certain variables, including the reference temperatures communicated by the trio of number sets 46.

The symbols 16 are operable to provide context to the numbers 14. The preferred display 10 includes a temperature symbol 56 indicating when lit that the number being displayed is a temperature measured in degrees Celsius; a voltage symbol 58 indicating when lit that the number being displayed is an electrical voltage measured in Volts (V); a decimal point 60 indicating the relationship of numbers right of the decimal point 60 to numbers 14 left of the decimal point 60; and a negative sign 62 indicating the positive or negative nature of the numbers 14.

The preferred display 10 is also shown further comprising a large thermometer icon 66 operable to convey relatively precise temperature information using a bar graph incorporated into the icon itself. The icon 66 is not able to provide the same degree of quantitative precision as the numbers 14, but is able to graphically communicate relative temperature conditions, unlike the small thermometer icon 40 which is only able to convey the existence or absence, but not the degree, of a temperature related condition. Where desirable and practical, any icon 12 may incorporate such graphical communication ability.

Figure 3:
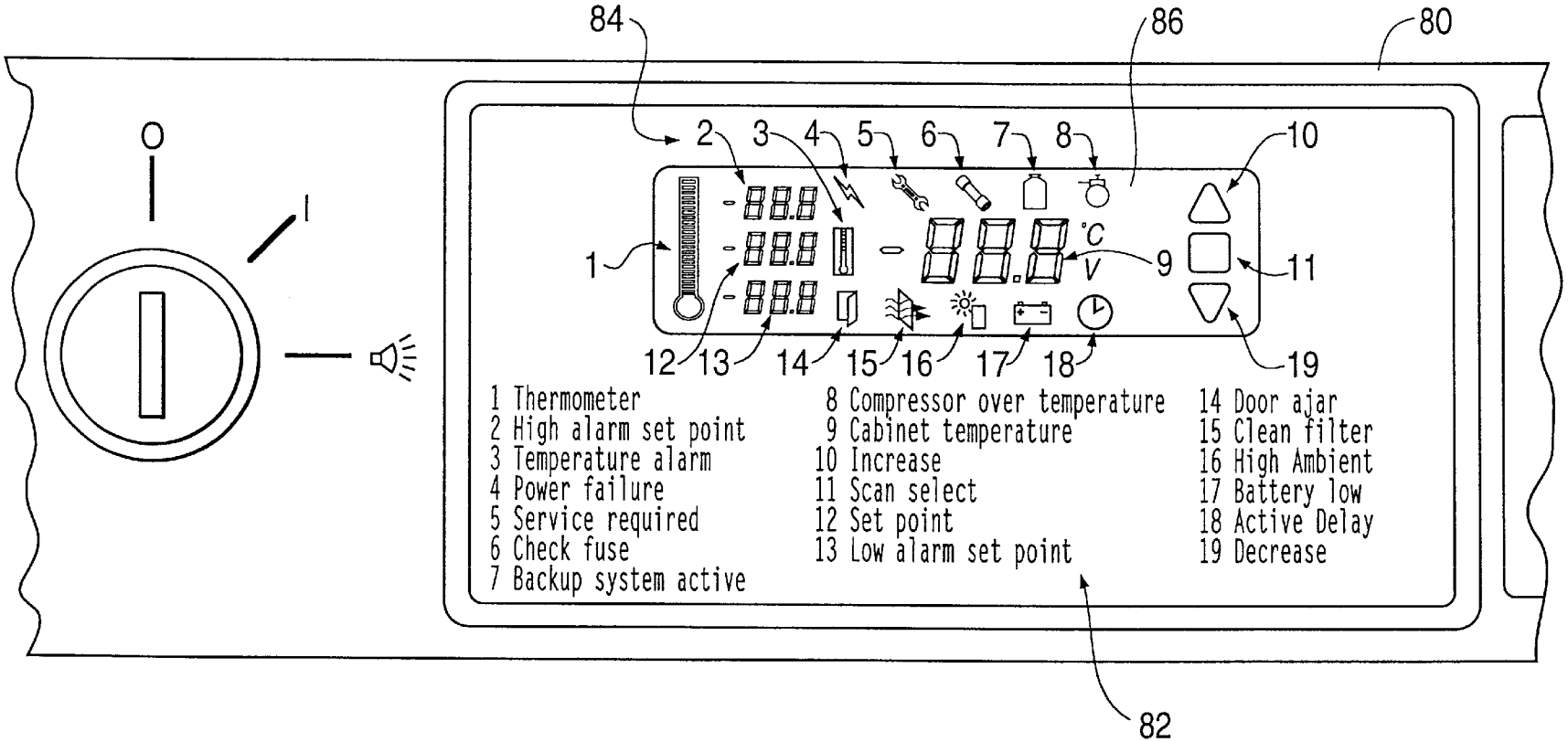
FIG. 3 is a plan view of a protective overlay of a preferred embodiment of the present invention.

FIG. 3 shows a portion of a protective cover 80 operable to detachably cover the mounted iconographic display 10 (as is shown in FIG. 1). The cover 80 is preferably protective plastic and includes a transparent portion behind which the display 10 is located and through which the display 10 is visible.

The cover 80 preferably includes a legend 82 defining the relevance of each icon 12 and number group 44,46. The legend 82 is keyed to alphanumeric references 84 printed on the cover 80 near or over a representation 86 of the display and indicating the icons or number groups to which the references 84 correspond. Thus, even were an operator to confuse or forget the meaning of an icon 12 or number group 44,46, the operator need only refer to the representative display 86 and legend 82 for immediate understanding. The cover 80 is preferably easily detachable so that a similar cover 80 having a legend 82 written in the most appropriate language may be substituted where desirable.

In operation, the iconographic display 10 is mounted to the low temperature refrigeration unit 5. The protective cover 80 is detachably secured over the display 10. At a glance, a technician is able to ascertain the operating conditions of the low temperature refrigeration unit 5. If, for example, a compressor overtemperature condition exists, the compressor icon 28 would be lit, the large number set 44 would communicate the compressor's temperature, and the temperature symbol 56 would be lit to provide context to the information communicated by the number set 44. The service icon 22 might also be lit to indicate a service condition exists which is causing the high compressor temperature.

In another example, the approximate temperature of the interior of the low temperature refrigeration unit 5 may be ascertained from the bar graph portion of the large thermometer icon 66. The range extremes (maximum and minimum) and set point of the interior temperature are communicated by the trio of three number sets 46. The actual interior temperature could be communicated by the large number set 44, in which case the temperature symbol 56 will be lit.

Although the invention has been described with reference to the preferred embodiment illustrated in the attached drawing figures, it is noted that equivalents may be employed and substitutions made herein without departing from the scope of the invention as recited in the claims. In particular, the present invention is for an vacuum fluorescent inconographic display 10 independent of any particular associated sensors, control and coordination electronics, or logic. The display 10 is also independent of any particular type of low temperature refrigeration unit. Furthermore, as previously discussed, the actual icons 12 and symbols 16 used and the actual arrangement of the icons 12, numbers 14, and symbols 16 is application dependent, and the present invention is not limited to the illustrated embodiments.

Having thus described the preferred embodiment of the invention, what is claimed as new and desired to be protected by letters patent includes the following:

1. A refrigeration unit comprising:

a housing partly defining an interior compartment, the housing presenting an opening allowing access to the interior compartment;

a door corresponding to the opening and operable in a closed position to close the opening and in an open position to allow access through the opening to the interior compartment;

a power supply connection connectable to a power source and operable when so connected to deliver power to the refrigeration unit;

at least one fuse operable to electrically disconnect at least a portion of the refrigeration unit from the power source;

a cooling system operable to cool the interior compartment to a desired temperature; and a vacuum fluorescent iconographic display operable to communicate information related to at least one operating condition of the refrigeration unit, the vacuum fluorescent iconographic display comprising a face presenting at least one iconic element visually identifiable as representing the operating condition, the iconic element being operable to illuminate in response to an electrical illumination signal, electronic circuitry operable to generate the electrical illumination signal and to control and coordinate the illumination of each iconic element, a first numeric display electrically connected to said electronic circuitry, and a second numeric display arranged as a trio of number groupings each electrically connected to said electronic circuitry.

2. The refrigeration unit as set forth in claim 1, the power having an actual voltage level, the iconic element representing the operating condition that the actual voltage level is different than a desired voltage level.

3. The refrigeration unit as set forth in claim 1, the interior compartment having an actual interior temperature, the iconic element representing the operating condition that the actual interior temperature is different than the desired interior temperature.

4. The refrigeration unit as set forth in claim 1, the iconic element representing the operating condition that the door is in the open position.

5. The refrigeration unit as set forth in claim 1, the iconic element representing the operating condition that the fuse has electrically disconnected the at least one portion of the refrigeration unit from the power source.

6. The refrigeration unit as set forth in claim 1, wherein said first numeric display is larger than said second numeric display.

7. The refrigeration unit as set forth in claim 1, wherein said second numeric display indicates temperature reference values.

8. A refrigeration unit having a vacuum fluorescent iconographic display operable to communicate information related to at least one operating condition of the refrigeration unit, the vacuum fluorescent iconographic display comprising:

a face presenting at least one iconic element visually identifiable as representing the operating condition, the iconic element being operable to illuminate in response to an electrical illumination signal;

electronic circuitry operable to generate the electrical illumination signal and to control and coordinate the illumination of each iconic element;

a first numeric display electrically connected to said electronic circuitry; and a second numeric display arranged as a trio of number groupings each electrically connected to said electronic circuitry.

9. The refrigeration unit as set forth in claim 8, the refrigeration unit having at least one serviceable component, the iconic element representing the operating condition that the serviceable component requires service.

10. The refrigeration unit as set forth in claim 9, the iconic element being a representation of a wrench.

11. The refrigeration unit as set forth in claim 8, the refrigeration unit receiving power from a source, the power having an actual voltage level and a desired voltage level, the iconic element representing the operating condition that the actual voltage level is different than the desired voltage level.

12. The refrigeration unit as set forth in claim 8, the refrigeration unit having an interior compartment, the interior compartment having an actual interior temperature and a desired interior temperature, the iconic element representing the operating condition that the actual interior temperature is different than the desired interior temperature.

13. The refrigeration unit as set forth in claim 12, the iconic element being a representation of a thermometer.

14. The refrigeration unit as set forth in claim 8, the refrigeration unit having an openable door, the iconic element representing the operating condition that the door is open.

15. The refrigeration unit as set forth in claim 14, the iconic element being a representation of an open door.

16. The refrigeration unit as set forth in claim 8, the refrigeration unit having a filter, the filter being susceptible to becoming clogged, the iconic element representing the condition that the filter is clogged.

17. The refrigeration unit as set forth in claim 16, the iconic element being a representation of a filter.

18. The refrigeration unit as set forth in claim 8, the refrigeration unit having a fuse, the fuse being operable to break an electrical circuit, the iconic element representing the condition that the fuse has broken the electric circuit.

19. The refrigeration unit as set forth in claim 8, the iconic element being a representation of a fuse.

20. The refrigeration unit as set forth in claim 8, the face further presenting at least one numeric element operable to display at least one numeral in response to the electrical illumination signal generated by the electronic circuitry, the electronic circuitry being further operable to control and coordinate the illumination of each numeric element.

21. The refrigeration unit as set forth in claim 20, the face further presenting at least one symbolic element operable to display a generally recognized symbol in response to the electrical illumination signal generated by the electronic circuitry, the generally recognized symbol conveying both broad and specific context to the numeral, the electronic circuitry being further operable to control and coordinate the illumination of each symbolic element.

22. The refrigeration unit as set forth in claim 21, the generally recognized symbol conveying one of the following broad contexts: mathematical, electrical, mechanical, scientific.

23. The refrigeration unit of claim 21, the generally recognized symbol conveying one of the following specific contexts: negativeness, exponent, voltage, current, pressure, temperature.

24. The refrigeration unit as set forth in claim 8, further comprising a protective cover operable to detachably and substantially transparently cover the vacuum fluorescent iconographic display.

25. The refrigeration unit as set forth in claim 24, the protective cover including a legend printed thereon, the legend communicating in a written language the operating condition which each iconic element represents.

26. The refrigeration unit as set forth in claim 8, wherein said first numeric display is larger than said second numeric display.

27. The refrigeration unit as set forth in claim 8, wherein said second numeric display indicates temperature reference values.

* * * * *